US007557680B2

(12) United States Patent
Kwon et al.

(10) Patent No.: US 7,557,680 B2
(45) Date of Patent: Jul. 7, 2009

(54) APPARATUS FOR WIDEBAND TRANSMISSION CONVERSION FROM COPLANAR WAVEGUIDE TO PARALLEL TRANSMISSION LINE

(75) Inventors: Do-hoon Kwon, Seoul (KR); Yong-jin Kim, Seoul (KR); Young-eil Kim, Suwon-si (KR); Young-min Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 129 days.

(21) Appl. No.: 11/340,694

(22) Filed: Jan. 27, 2006

(65) Prior Publication Data

US 2006/0192629 A1 Aug. 31, 2006

(30) Foreign Application Priority Data

Feb. 25, 2005 (KR) ..... 10-2005-0015724

(51) Int. Cl.
*H01P 5/00* (2006.01)

(52) U.S. Cl. ..... 333/260; 333/33; 333/246

(58) Field of Classification Search ..... 333/260, 333/238, 246, 32, 33
See application file for complete search history.

(56) References Cited

U.S. PATENT DOCUMENTS 5,561,405 A * 10/1996 Hoffmeister et al. ..... 333/34
5,917,388 A * 6/1999 Tronche et al. ..... 333/246

OTHER PUBLICATIONS

Kwon et al. (A Wideband Vertical Transition Between Co-Planar Waveguide and parallel-Strip Transmission Line) Sep. 2005, IEEE Microwave and Wireless Components Letters vol. 15, No. 9.*

* cited by examiner

*Primary Examiner*—Stephen E Jones
(74) *Attorney, Agent, or Firm*—Sughrue Mion, PLLC

(57) ABSTRACT

A transmission line conversion apparatus connecting a parallel transmission line to a coplanar waveguide (CPW) is provided. To this end, the CPW including a transmission line composed of a signal line and a ground line which is formed on one surface of a dielectric substrate, and a parallel transmission line connected to the CPW, at a predetermined angle with respect to a substrate constituting the CPW, and composed of a signal line and a ground line, are proposed. In addition, the signal line of the CPW and the signal line of the parallel transmission line are connected to each other, and the ground line of the CPW and the ground line of the parallel transmission line are connected to each other. As such, by connecting the CPW to the parallel transmission line, a return loss can be minimized.

13 Claims, 8 Drawing Sheets

APPARATUS FOR WIDEBAND TRANSMISSION CONVERSION FROM COPLANAR WAVEGUIDE TO PARALLEL TRANSMISSION LINE

CROSS-REFERENCE TO RELATED APPLICATIONS

This application claims priority under 35 U.S.C. § 119 from Korean Patent Application No. 10-2005-0015724 filed on Feb. 25, 2005 in the Korean Intellectual Property Office, the entire content of which is incorporated herein by reference.

BACKGROUND OF THE INVENTION

1. Field of the Invention

Apparatuses consistent with the present invention relate to a wideband transmission line conversion technique of connecting a coplanar waveguide (CPW) to a parallel transmission line having a predetermined angle from a substrate.

2. Description of the Related Art

Many techniques for connecting a microstrip to another microstrip have been proposed in the related art. FIG. 1 shows the conventional case of connecting a microstrip to another microstrip. Hereinafter, a signal line and a ground line will be collectively referred to as a transmission line for simplicity of description. The signal line 100 and the ground line 102 of two microstrips formed in a mutually orthogonal manner are connected to each other. When two microstrips are connected as shown in FIG. 1, a signal delivered from the signal line 100 of one microstrip is delivered to the signal line 100 of the other microstrip without any reflection. However, a portion of a substrate of one microstrip must be removed in order to connect the substrate disposed in a horizontal direction to the substrate disposed in a vertical direction. That is, the signal lines 100 of the two microstrips can be connected to each other when a portion of one substrate of one microstrip is removed.

In addition, it is assumed that a signal is transmitted from the signal line 100 of the substrate disposed in a horizontal direction to the signal line 100 of the substrate disposed in a vertical direction, and the signal line 100 of the substrate disposed in the vertical direction is disposed from an upward direction toward a downward direction. In this case, a portion of the substrate disposed in the horizontal direction must be removed as shown in FIG. 1, and a transmission line must extend so as to rotate the transmission line 100 of the substrate disposed in the horizontal direction by 180 degrees.

FIG. 2 shows a case of connecting a CPW to a microstrip in the related art. A signal line 200 of the microstrip and a signal line 200 of the CPW, which are disposed in a mutually orthogonal manner, are connected to each other, and a ground line 202 of the microstrip and a ground line 202 of the CPW are connected to each other. However, a connection structure shown in FIG. 2 is disadvantageous in that an area of the ground line is large so that it occupies a large space and a transmission line of the microstrip and a transmission line of the CPW cannot be stably adhered to each other.

As such, a technique of connecting two microstrips to each other and a technique of connecting the CPW to the microstrip have been proposed in the related art. However, a technique of connecting the CPW to the parallel transmission line was not proposed in the related art.

SUMMARY OF THE INVENTION

It is therefore one object of the present invention to provide a technique of connecting a parallel transmission line to a CPW.

It is another object of the present invention to provide a technique of connecting a CPW to a parallel transmission line which can be used in a wideband.

It is yet another object of the present invention to provide a technique of connecting a CPW to a parallel transmission which has a less insertion loss and a less return loss.

According to one aspect of the present invention, there is provided a transmission line conversion apparatus, which includes: a CPW including a transmission line composed of a signal line and a ground line; and a parallel transmission line connected to the CPW, maintaining a constant angle with respect to a substrate constituting the CPW, and composed of a signal line and a ground line.

According to another aspect of the present invention, there is provided a transmission line conversion apparatus, which includes: a first transmission line composed of a signal line and a ground line, and formed by removing a portion of a metal layer coated on one surface of a dielectric substrate; and a second transmission line connected to the first transmission line at a set angle, and composed of a signal line and a ground line using two metal plates.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Hereinafter, a technique of connecting a parallel transmission line to a CPW proposed by the present invention will be described in detail with reference to accompanying drawings.

Figure 1:
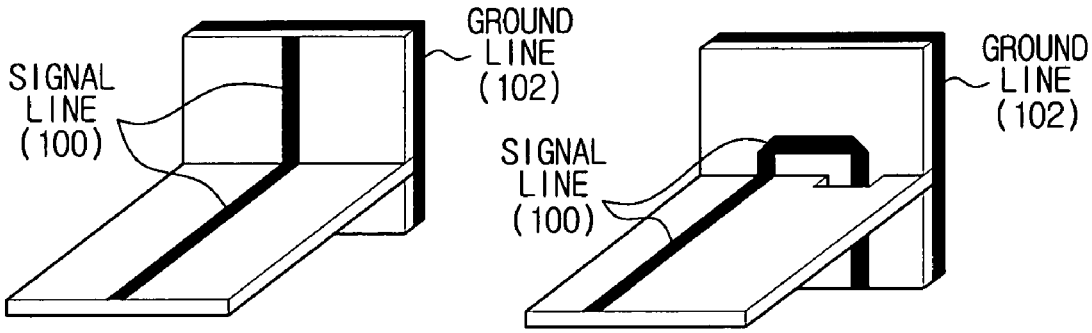
FIG. 1 (PRIOR ART)
FIG. 1 is a view illustrating a connection structure for connecting two microstrips to each other in the related art.
Figure 2:
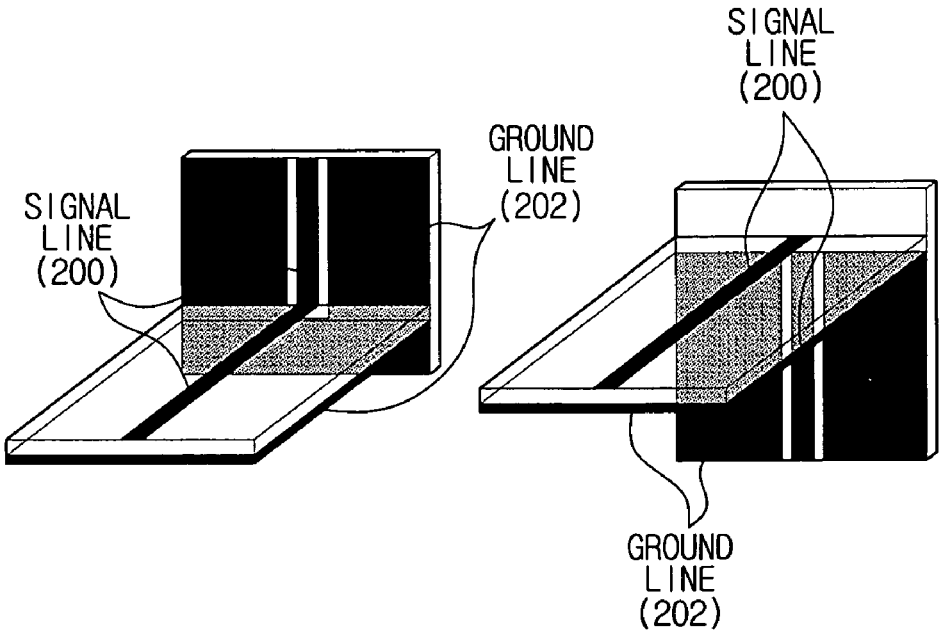
FIG. 2 (PRIOR ART)
FIG. 2 is a view illustrating a connection structure for connecting a microstrip to a CPW in the related art.
Figure 3:
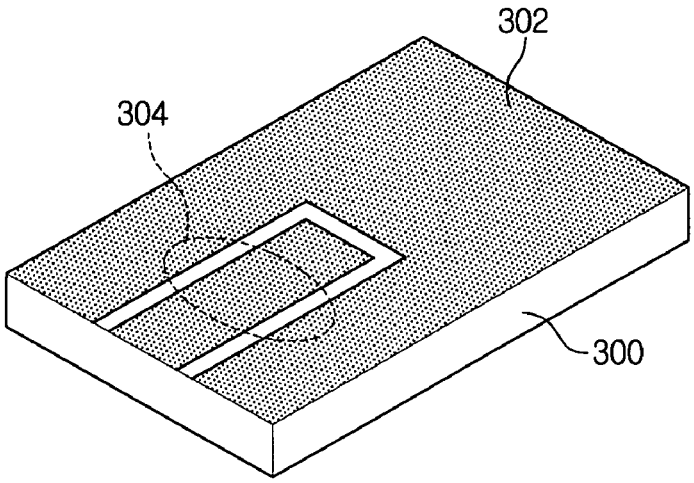
FIG. 3 is a view illustrating formation of a CPW in accordance with an exemplary embodiment of the present invention.

FIG. 3 shows a CPW associated with an exemplary embodiment of the present invention. The CPW allows one surface of a substrate 300 to be coated by a metal layer 302. In addition, a portion of the metal layer 302 is removed in order to discriminate a ground line from a signal line for transmitting a signal. Referring to FIG. 3, the metal layer 302 is removed like a "⊃" shape to discriminate the ground line from the signal line. That is, the ground line is shaped to surround the signal line, and the CPW is an unbalanced transmission line in which a shape of the ground line is not the same as the signal line.

Figure 4:
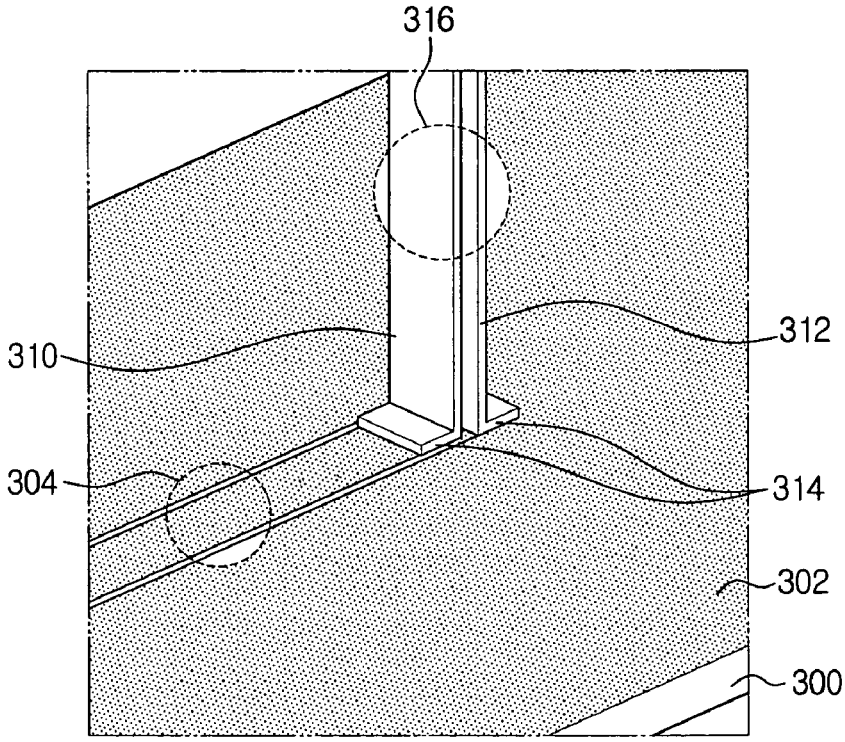
FIG. 4 is a view illustrating a connection structure of connecting a parallel transmission line to a CPW in accordance with an exemplary embodiment of the present invention.

FIG. 4 is a view illustrating a connection structure of connecting a parallel transmission line to a CPW in accordance with an exemplary embodiment of the present invention.

FIG. 4 shows a substrate 300, a metal layer 302 coated on the substrate 300, a CPW 304 formed in the metal layer 302, and a parallel transmission line 316. As described above, the parallel transmission line 316 is composed of a signal line 310 and a ground line 312, and is a balanced transmission line in which a structure of the signal line 310 is same as the ground line 312. The signal line of the CPW 304 is connected to the signal line 310 of the parallel transmission line, and the ground line of the CPW is connected to the ground line 312 of the parallel transmission line. A width of the signal line of the CPW 304 is equal to a width of the signal line 310 of the parallel transmission line 316. An interval between the ground line 312 and the signal line 310 of the parallel transmission line 316 is the same as an interval between the signal line and the ground line of the CPW 304.

An air layer is formed in a space between the signal line 310 and the ground line 312 which constitute the parallel transmission line 316, so that a separate dielectric substrate is not used. However, the parallel transmission line 316 may be formed on the dielectric substrate in response to a setting of a user.

In addition, the signal line, of the CPW 304 is formed by a predetermined length, and is surrounded by the ground line. That is, the signal line implements an open circuit on the CPW 304.

FIG. 4 shows that the parallel transmission line 316 is vertically formed on the substrate 300, however, an angle of the parallel transmission line 316 with respect to the substrate 300 can be set to a different value in response to setting of a user. In addition, referring to FIG. 4, a portion of the ground line 312 of the parallel transmission line 316 is bent, and the bent portion is used for connection with the ground line of the CPW 304 so as to facilitate connection between the ground line 312 of the parallel transmission line 316 and the ground line of the CPW 304. It is needless to say that the same technique can also be applied for connecting the signal line 310 of the parallel transmission line 316 to the signal line of the CPW 304. Alternatively, a pad 314 may be used to connect the ground line of the CPW 304 to the ground line 312 of the parallel transmission line 316 or to connect the signal line of the CPW 304 to the signal line 310 of the parallel transmission line 316.

FIG. 5 shows an electric field distribution at each position of the connection structure proposed by an exemplary embodiment of the present invention. FIG. 5A shows the connection structure of the parallel transmission line and the CPW proposed by an exemplary embodiment of the present invention and each position denoted by "A" to "D".

Figure 5A:
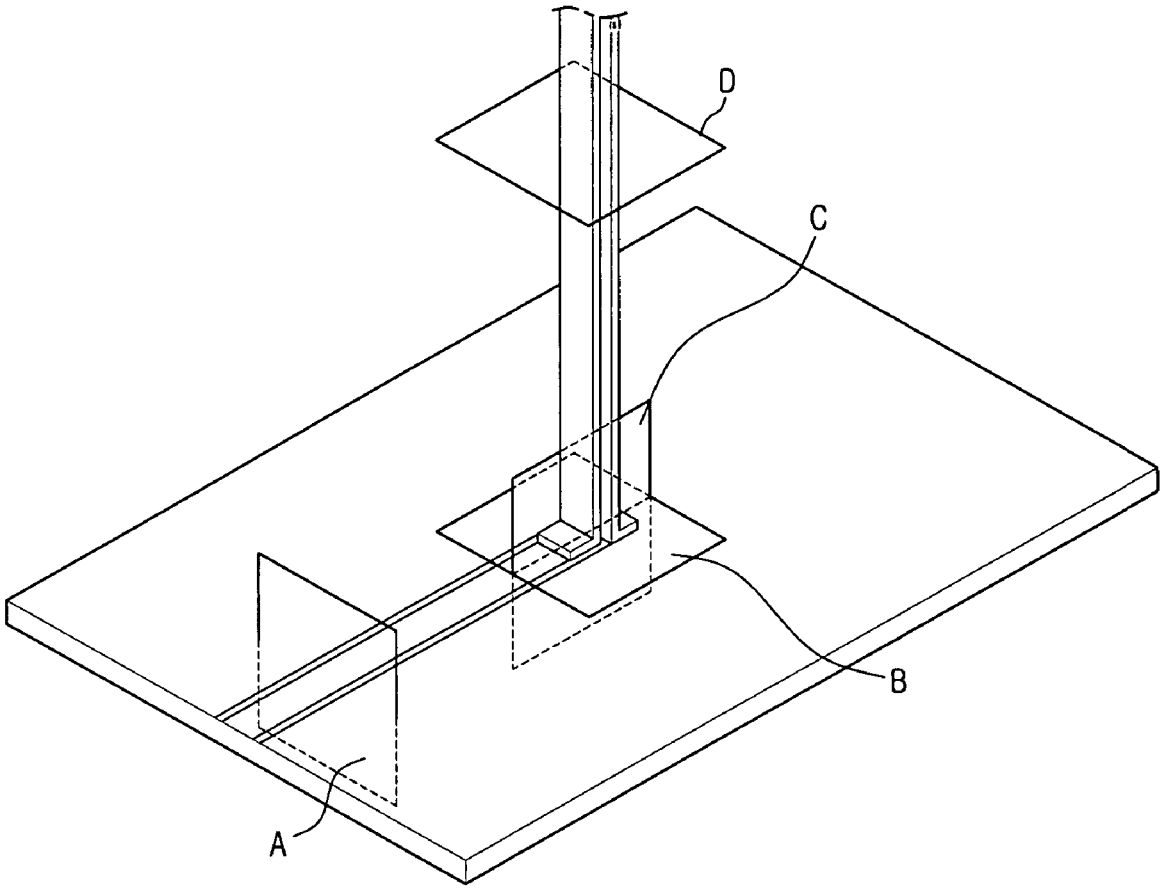
FIGS. 5A to 5E are views illustrating respective electric fields at positions of a parallel transmission line and a CPW in accordance with an exemplary embodiment of the present invention.
Figure 5B:
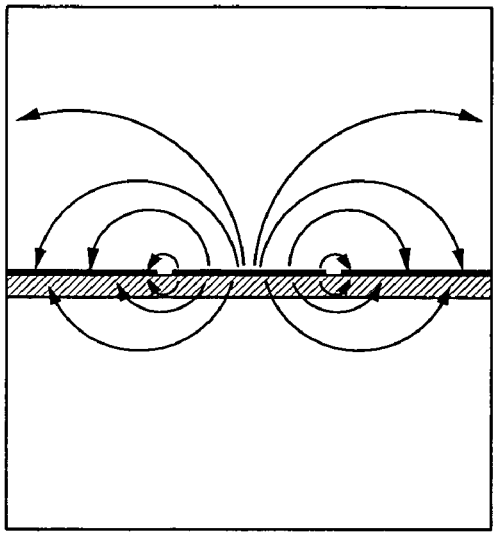
Figure 5C:
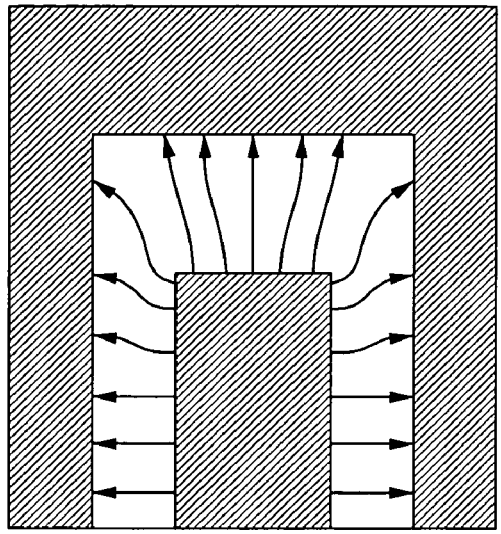
Figure 5D:
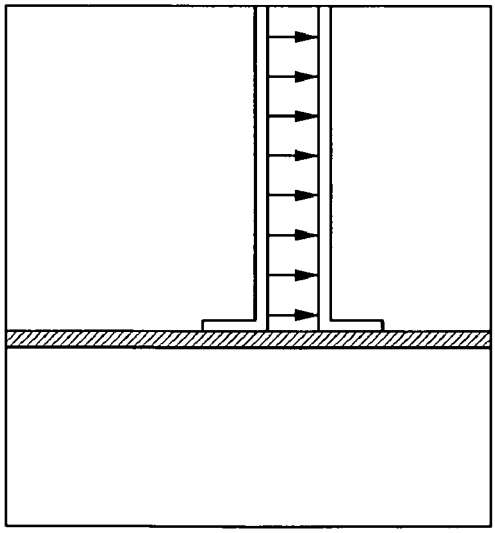
Figure 5E:
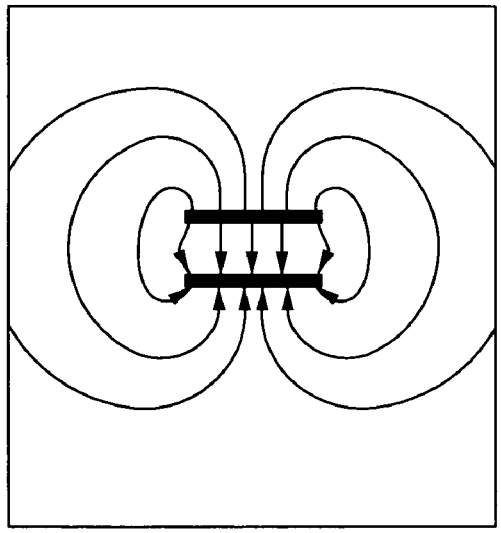

FIG. 5B shows an electric field distribution at "A" position, and FIG. 5C shows an electric field distribution at "B" position. FIG. 5D shows an electric field distribution at "C" position, and FIG. 5E shows an electric field distribution at "D" position. As shown in FIG. 5A to 5E, it can be seen that the electric field is generated toward the ground line from the signal line.

Figure 6:
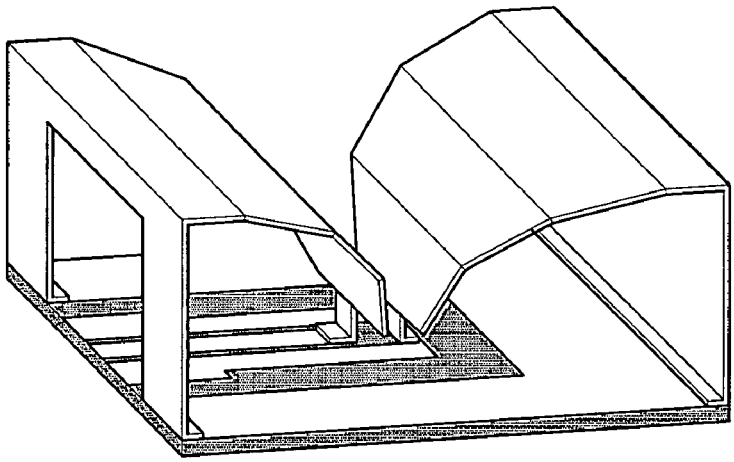
FIG. 6 is a view illustrating an antenna using a parallel transmission line and a CPW in accordance with an exemplary embodiment of the present invention.

FIG. 6 shows a wideband unidirectional antenna using a parallel transmission line and a CPW proposed by an exemplary embodiment of the present invention. The CPW and the parallel transmission line (i.e. power feed section) are vertically connected to each other so as to allow the power to be fed in the wideband antenna shown in FIG. 6. A signal delivered to the power feed section is delivered to an irradiation section. Accordingly, manufacture of the power feed section, which was a problem caused by feeding the power using the microstrip in the related art, can be facilitated. It is needless to say that the structure of the antenna is not limited to the structure shown in FIG. 6.

Figure 7:
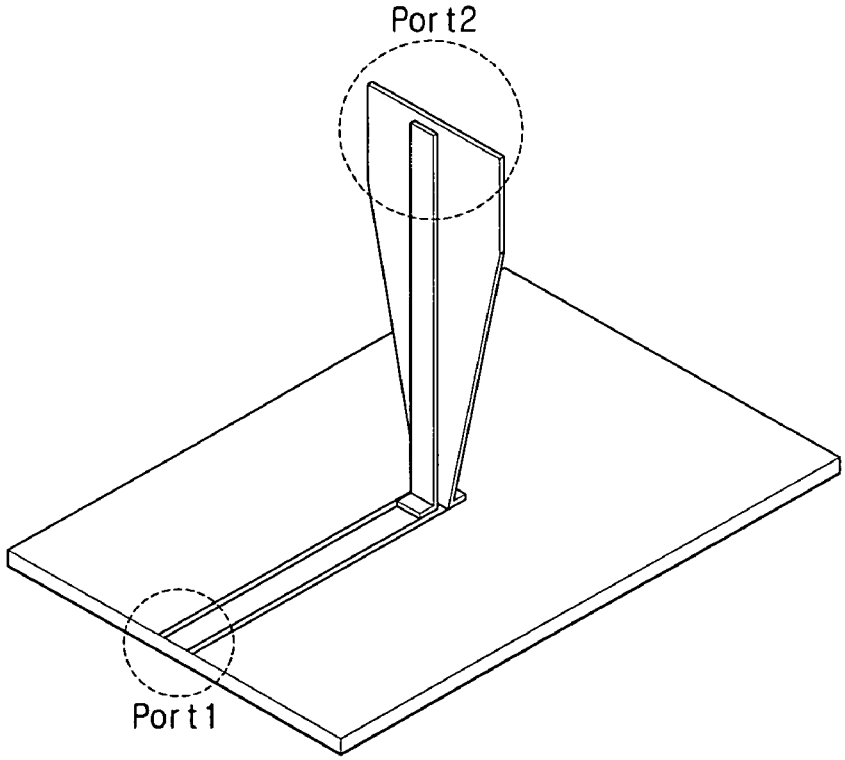
FIG. 7 is a view illustrating a connection structure for connecting a microstrip to a CPW in accordance with an exemplary embodiment of the present invention.

FIG. 7 shows the connection between a parallel transmission line and a CPW in accordance with another exemplary embodiment of the present invention. In particular, referring to FIG. 7, the parallel transmission line is implemented as a microstrip. In particular, a pad is used to connect the CPW to the microstrip for facilitating the connection.

Figure 8:
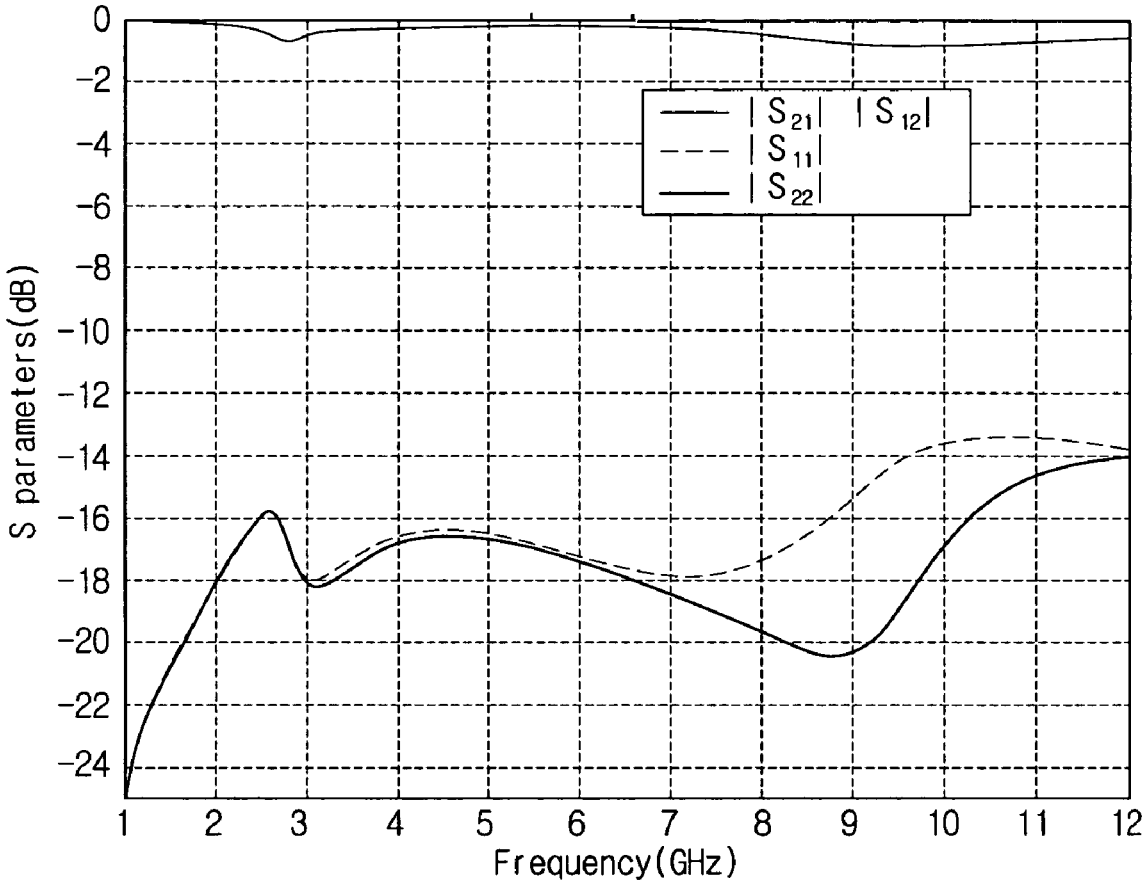
FIG. 8 is a view illustrating an exemplary effect of the connection structure shown in FIG. 7.

FIG. 8 shows S (i.e. scattering) parameters between a first port positioned on the CPW and a second port positioned on the microstrip as shown in FIG. 7.

The S parameter is the most widely used parameter in a radio frequency (RF) field. The S parameter means a ratio of an input power to an output power on a frequency. For example, when a term S21 is used, it means the ratio between the power input at the first port and the power output at the second port.

In particular, referring to FIG. 8, it is assumed that a width of the signal line of the CPW is 1.5 mm, a width of the metal layer removed for discriminating the signal line from the ground line is 0.16 mm, and a length of the transmission line is 25 mm. In addition, it is assumed that a thickness of the metal layer of the microstrip is 0.2 mm, a width of the signal line connected to the CPW is 1.5 mm, and a width of the terminating signal line (i.e. the second port) is 2 mm. In addition, it is assumed that a width of the ground line of the microstrip connected to the CPW is 1.94 mm, and a width of the terminating ground line (i.e. the second port) is 8 mm. It is assumed that an interval between the ground line and the signal line of the microstrip is 0.5 mm, and a length of the transmission line of the microstrip is 20 mm.

FIG. 8 shows the S parameters in a range of 1 GHz to 12 GHz. That is, the S parameters include a ratio S11 of a power output from the first port to a power reflected to the first port, a ratio S22 of a power output from the second to a power reflected to the second port, a ratio S21 of a power output from the first port to a power delivered to the second port, and a ratio S12 of a power output from the second port to a power reflected to the first port. In general, S12 has the same value as S21.

As shown in FIG. 8, most of the power delivered to the first port is delivered to the second port. The connection structure proposed by the present invention can be employed to minimize the insertion loss. That is, the insertion loss is very low enough to −1 dB or less.

Figure 9:
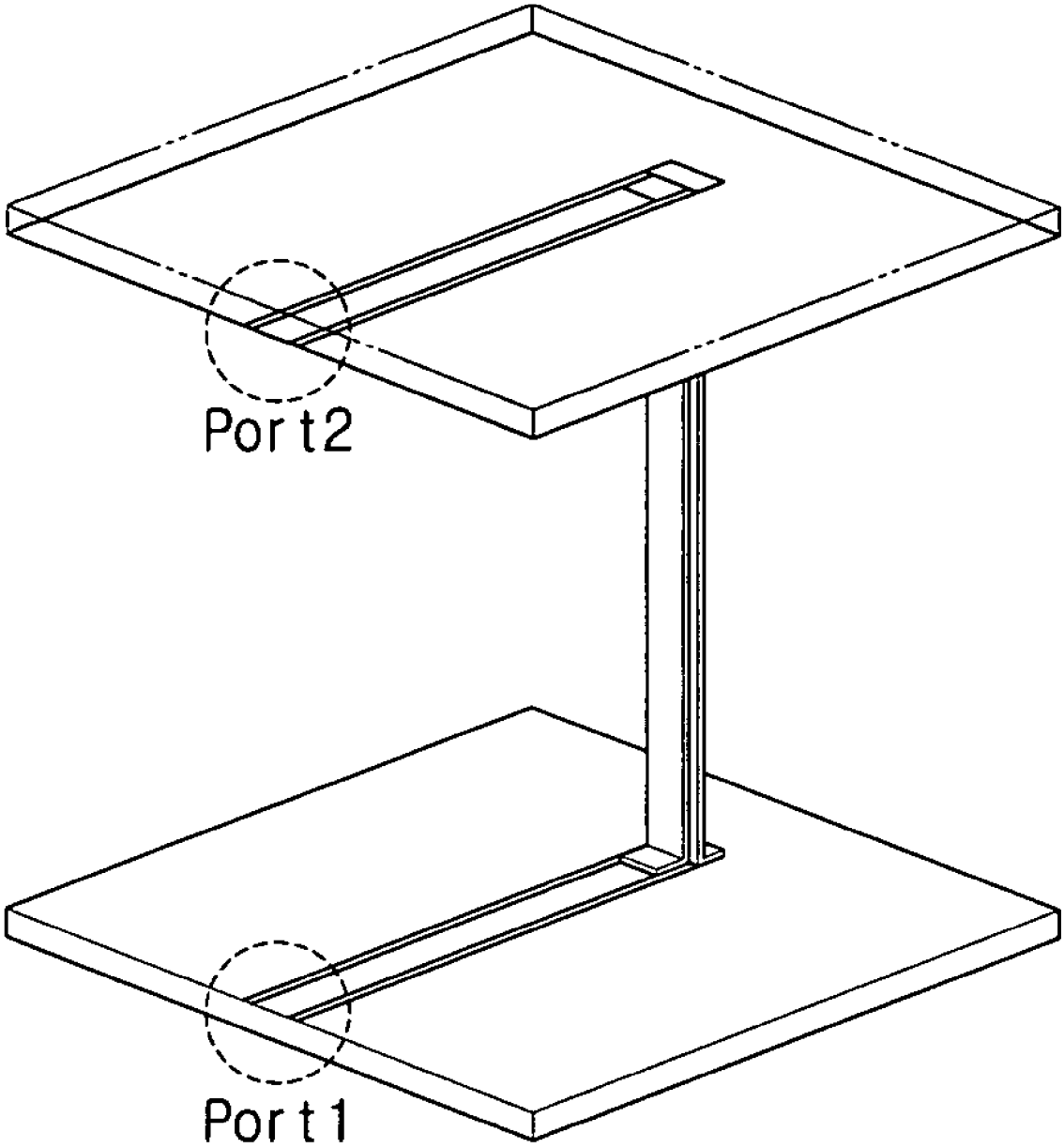
FIG. 9 is a view illustrating a connection structure for connecting two CPWs to a parallel transmission line in accordance with an exemplary embodiment of the present invention.

FIG. 9 shows the connection between one parallel transmission line and two CPWs in accordance with yet another exemplary embodiment of the present invention.

Figure 10:
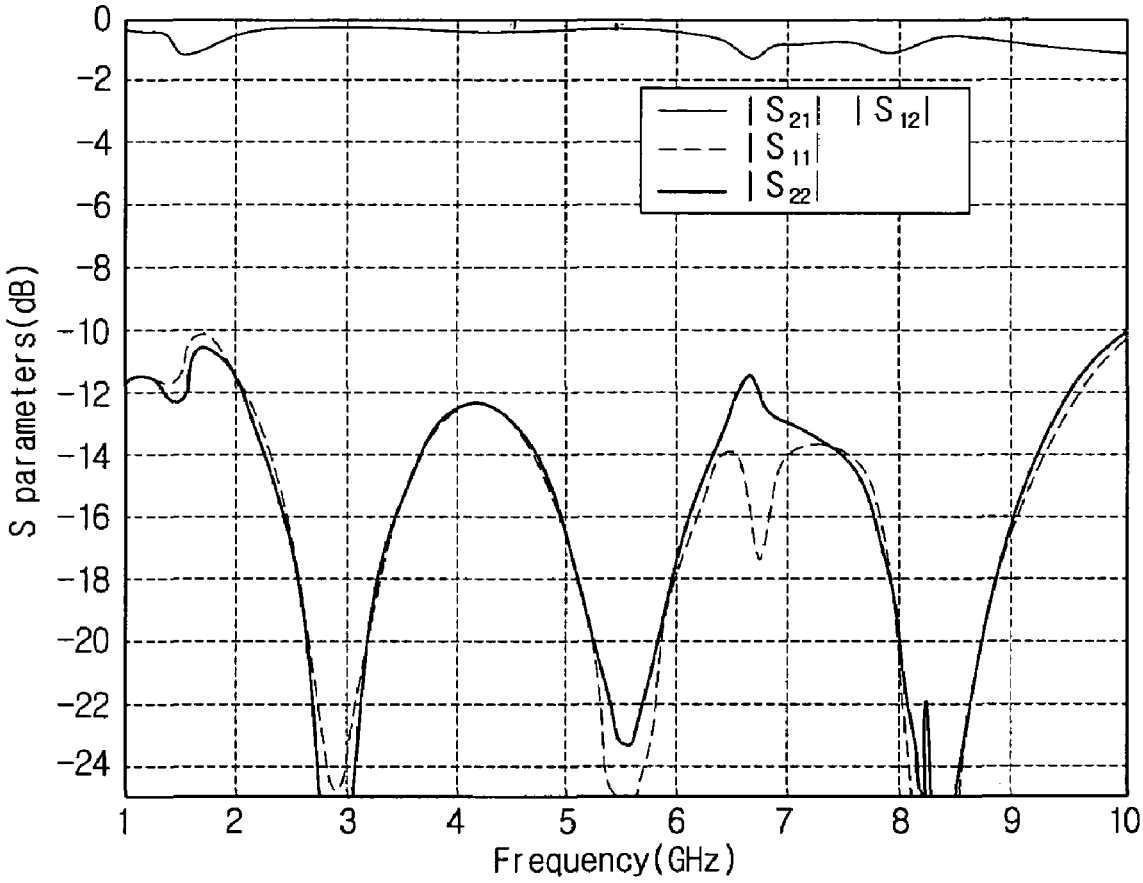
FIG. 10 is a view illustrating an exemplary effect of the connection structure shown in FIG. 9.

FIG. 10 shows the S parameter between the first port positioned on the first CPW and the second port positioned on the second CPW as shown in FIG. 9.

In particular, referring to FIG. 10, it is assumed that a width of the CPW is 1.5 mm, a width of the metal layer removed for discriminating the signal line from the ground line is 0.16 mm, and a length of the transmission line is 15 mm. In addition, each thickness of the signal line and the ground line which constitute the parallel transmission line is 0.2 mm, a width of the signal line is 1.5 mm, and a width of the ground line is 1.82 mm. In addition, it is assumed that an interval between the signal line and the ground line of the parallel transmission line is 0.22 mm, and a length of the transmission line is 20 mm.

FIG. 10 shows the S parameter in a range of 1 GHz to 10 GHz. As shown in FIG. 10, most of the power delivered to the first port is delivered to the second port. The connection structure proposed by the present invention can be employed to minimize the insertion loss. That is, the insertion loss is very low enough to −1.5 dB or less. The return loss is also low enough to −10 dB or more at the minimum so that the characteristic is good.

As described above, the present invention proposes a technique of connecting the CPW and the parallel transmission line. The conversion (i.e. connection) structure proposed by the exemplary embodiments of the present invention is employed to allow the power output from the first port to be delivered to the second port without any reflection. That is, the connection structure proposed by the present invention can minimize the return loss.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A transmission line conversion apparatus, comprising:

a coplanar waveguide (CPW) comprising a transmission line, wherein the transmission line comprises a first signal line and a first ground line disposed on a same plane; and a parallel transmission line connected to the CPW at a predetermined angle with respect to a substrate constituting the CPW, wherein the parallel transmission line comprises a second signal line and a second ground line disposed on different planes, wherein an area of the second ground line is substantially smaller than the first ground line, wherein, for signal transmission, the first and second signal lines are connected to each other, and the first and second ground lines are connected to each other, and wherein the first ground line is not connected to any ground line of the parallel transmission line other than the second ground line for the signal transmission.

2. The transmission line conversion apparatus according to claim 1, wherein the CPW and the parallel transmission line are connected to each other using a pad.

3. The transmission line conversion apparatus according to claim 1, wherein a width of the first signal line of the CPW is equal to a width of the second signal line of the parallel transmission line.

4. The transmission line conversion apparatus according to claim 1, wherein the predetermined angle is 90 degrees.

5. The transmission line conversion apparatus according to claim 1, wherein the first signal line and the first ground line of the CPW are formed by coating one surface of a dielectric substrate with a metal layer and removing a portion of the coated metal layer.

6. The transmission line conversion apparatus according to claim 5, wherein the first signal line of the CPW is composed of an open circuit, and is surrounded by the first ground line of the CPW.

7. A transmission line conversion apparatus, comprising:

a coplanar waveguide (CPW) comprising a transmission line, wherein the transmission line comprises a signal line and a ground line; and a parallel transmission line connected to the CPW at a predetermined angle with respect to a substrate constituting the CPW, wherein the parallel transmission line comprises a signal line and a ground line, and wherein the CPW is an unbalanced transmission line in which a shape of the ground line is not the same as the signal line and the parallel transmission line is a balanced transmission line in which a shape of the ground line is not different from the signal line.

8. A transmission line conversion apparatus comprising:

a coplanar waveguide (CPW) comprising a transmission line, wherein the transmission line comprises a first signal line and a first ground line disposed on a same plane; and a parallel transmission line connected to the CPW at a predetermined angle with respect to a substrate constituting the CPW, wherein the parallel transmission line comprises a second signal line and a second ground line disposed on different planes, wherein, for signal transmission, the first and second signal lines are connected to each other, and the first and second ground lines are connected to each other, wherein the first ground line is not connected to any ground line of the parallel transmission line other than the second ground line for the signal transmission, and wherein the second signal line and the second ground line of the parallel transmission line are spaced apart from each other by a predetermined distance by an air layer.

9. A transmission line conversion apparatus, comprising:

a first transmission line composed of a signal line and a ground line, and formed by removing a portion of a metal layer coated on one surface of a dielectric substrate; and a second transmission line connected to the first transmission line at a set angle, and composed of a signal line and a ground line using two metal plates, wherein the first transmission line is an unbalanced transmission line in which a shape of the ground line is not the same as the signal line and the second transmission line is a balanced transmission line in which a shape of the ground line is not different from the signal line.

10. A transmission line conversion apparatus comprising:

a first transmission line comprising a first signal line and a first ground line disposed on a same plane, and formed by removing a portion of a metal layer coated on one surface of a dielectric substrate; and a second transmission line connected to the first transmission line at a set angle, and comprising a second signal line and a second ground line disposed on different planes using two metal plates, wherein, for signal transmission, the first and second signal lines are connected to each other, and the first and second ground lines are connected to each other, wherein the first ground line is not connected to any ground line of the parallel transmission line other than the second ground line for the signal transmission, and wherein the second signal line and the second ground line of the second transmission line are spaced apart from each other by a predetermined distance by an air layer.

11. A transmission line conversion apparatus, comprising:

a first transmission line comprising a first signal line and a first ground line disposed on a same plane, and formed by removing a portion of a metal layer coated on one surface of a dielectric substrate; and a second transmission line connected to the first transmission line at a set angle, and comprising a second signal line and a second ground line disposed on different planes using two metal plates, wherein an area of the second ground line is substantially smaller than the first ground line, wherein, for signal transmission, the first and second signal lines are connected to each other, and the first and second ground lines are connected to each other, and wherein the first ground line is not connected to any ground line of the parallel transmission line other than the second ground line for the signal transmission.

12. The transmission line conversion apparatus according to claim 11, wherein the set angle is 90 degrees.

13. The transmission line conversion apparatus according to claim 11, wherein the first transmission line is a part of a coplanar waveguide (CPW).

* * * * *